US010677560B2

(12) United States Patent
Neyra

(10) Patent No.: US 10,677,560 B2
(45) Date of Patent: Jun. 9, 2020

(54) GRIP SUPPORT HARNESS

(71) Applicant: Eduardo J. Neyra, Denver, CO (US)

(72) Inventor: Eduardo J. Neyra, Denver, CO (US)

( * ) Notice: Subject to any disclaimer, the term of this patent is extended or adjusted under 35 U.S.C. 154(b) by 0 days.

(21) Appl. No.: 16/244,388

(22) Filed: Jan. 10, 2019

(65) Prior Publication Data

US 2019/0376763 A1 Dec. 12, 2019

Related U.S. Application Data

(60) Provisional application No. 62/682,126, filed on Jun. 7, 2018.

(51) Int. Cl.
*F41C 33/00* (2006.01)

(52) U.S. Cl.
CPC ..... *F41C 33/001* (2013.01)

(58) Field of Classification Search
CPC ..... F41C 33/001
USPC ..... 42/90, 94, 106; 2/161.5; 294/25
See application file for complete search history.

(56) References Cited

U.S. PATENT DOCUMENTS

| | | | | |
|---|---|---|---|---|
| 1,177,748 | A * | 4/1916 | Webster | F41A 21/08 42/106 |
| 4,796,306 | A * | 1/1989 | Mitchell | A63B 71/148 2/161.5 |
| 4,986,019 | A * | 1/1991 | Dennis, Jr. | F41A 3/04 42/106 |
| 6,195,927 | B1 * | 3/2001 | Fortenberry | F41C 33/001 42/90 |
| 6,678,986 | B2 * | 1/2004 | Roush | A41D 19/0157 2/159 |
| 2012/0242098 | A1 * | 9/2012 | Yu | F41C 33/001 294/25 |

* cited by examiner

*Primary Examiner* — Bret Hayes
(74) *Attorney, Agent, or Firm* — Michael Carey

(57) ABSTRACT

A grip support harness is described. The grip support harness may include a wrist cuff, a primary support strap connected to the wrist cuff, a primary connecting component connected to the wrist cuff; a secondary support strap connected to the wrist cuff and a secondary connecting component connected to the wrist cuff.

16 Claims, 3 Drawing Sheets

GRIP SUPPORT HARNESS

CROSS-REFERENCE TO RELATED APPLICATION

This application claims priority to, and the benefit of, U.S. Provisional Application Ser. No. 62/682,126, filed on Jun. 7, 2018, entitled GRIP SUPPORT HARNESS. The entire contents of the foregoing application are hereby incorporated by reference for all purposes.

BACKGROUND

The following relates generally to sporting equipment, and more specifically to supporting hand grip for the operation of sporting equipment.

Sporting activities can be an excellent form of entertainment, physical exercise and therapy. However, some people may have disabilities that make it difficult for them to participate in certain sporting activities. For example, a person with limited grip strength or control may find it difficult to participate in activities that include gripping sporting equipment such as a firearm. This may prevent them from engaging in these activities and enjoying the many benefits associated with participation.

SUMMARY

A grip support harness is described that may enable a person with limited grip strength or hand control to grip and operate sporting equipment such as firearms. The grip support harness may include a wrist cuff or forearm support to secure the harness to the arm or hand, and one or more straps that wrap around the hand to support the grip. The grip support harness may enable some people to engage in activities that may not be practical otherwise. This may result in additional opportunities for entertainment, physical therapy or rehabilitation.

Specifically, an apparatus for supporting hand grip is described. The apparatus may include a wrist cuff, a primary support strap connected to the wrist cuff, the primary support strap comprising a primary tensioning component, a primary connecting component connected to the wrist cuff, a secondary support strap connected to the wrist cuff, the secondary support strap comprising a secondary tensioning component, and a secondary connecting component connected to the wrist cuff.

A method of manufacturing an apparatus for supporting hand grip is described. The method may include providing a wrist cuff, providing a primary support strap connected to the wrist cuff, the primary support strap comprising a primary tensioning component, providing a primary connecting component connected to the wrist cuff, providing a secondary support strap connected to the wrist cuff, the secondary support strap comprising a secondary tensioning component, and providing a secondary connecting component connected to the wrist cuff.

A method of using an apparatus for supporting hand grip of sporting equipment is described. The method may include using a wrist cuff, using a primary support strap connected to the wrist cuff, the primary support strap comprising a primary tensioning component, using a primary connecting component connected to the wrist cuff, using a secondary support strap connected to the wrist cuff, the secondary support strap comprising a secondary tensioning component, and using a secondary connecting component connected to the wrist cuff.

Some examples of the apparatus and method described above may further include a firing lanyard connected to the primary support strap. In some examples of the apparatus and method described above, the firing lanyard comprises a high visibility color distinct from a color of the wrist cuff, a color of the primary support strap, and a color of the secondary support strap.

Some examples of the apparatus and method described above may further include one or more finger loops connected to the primary support strap. In one embodiment, the finger loops may include a one or more pieces of webbing material sewn onto the primary support strap. Some examples of the apparatus and method described above may further include a thumb protector connected to the secondary support strap. In some examples of the apparatus and method described above, the thumb protector comprises a leather strip.

In some examples of the apparatus and method described above, the secondary support strap is offset from the primary support strap at an angle between 0 degrees and 45 degrees. In some examples of the apparatus and method described above, the wrist cuff comprises a forearm support.

In some examples of the apparatus and method described above, the wrist cuff, the primary support strap, the secondary support strap, or any combination thereof comprises a webbing material. In some examples of the apparatus and method described above, the webbing material comprises cotton, nylon, polypropylene, polyester, dyneema, kevlar, or any combination thereof.

In some examples of the apparatus and method described above, the primary connecting component, the secondary connecting component or both comprise a slide, a loop, a D-ring, a hook, a buckle, a magnetic buckle, a spring link, a carabiner, a hook and loop fastener, or any combination thereof. In some examples of the apparatus and method described above, the wrist cuff comprises a loop, a slide a D-ring, a hook and loop fastener, or any combination thereof.

In some examples of the apparatus and method described above, the primary support strap and the secondary support strap are sewn onto the wrist cuff. Some examples of the apparatus and method described above may further include a tensioning strap connected to the wrist cuff. In some examples of the apparatus and method described above, the wrist cuff, the primary support strap, the secondary support strap, or any combination thereof comprises a leather material.

DETAILED DESCRIPTION OF THE DRAWINGS

Figure 1:
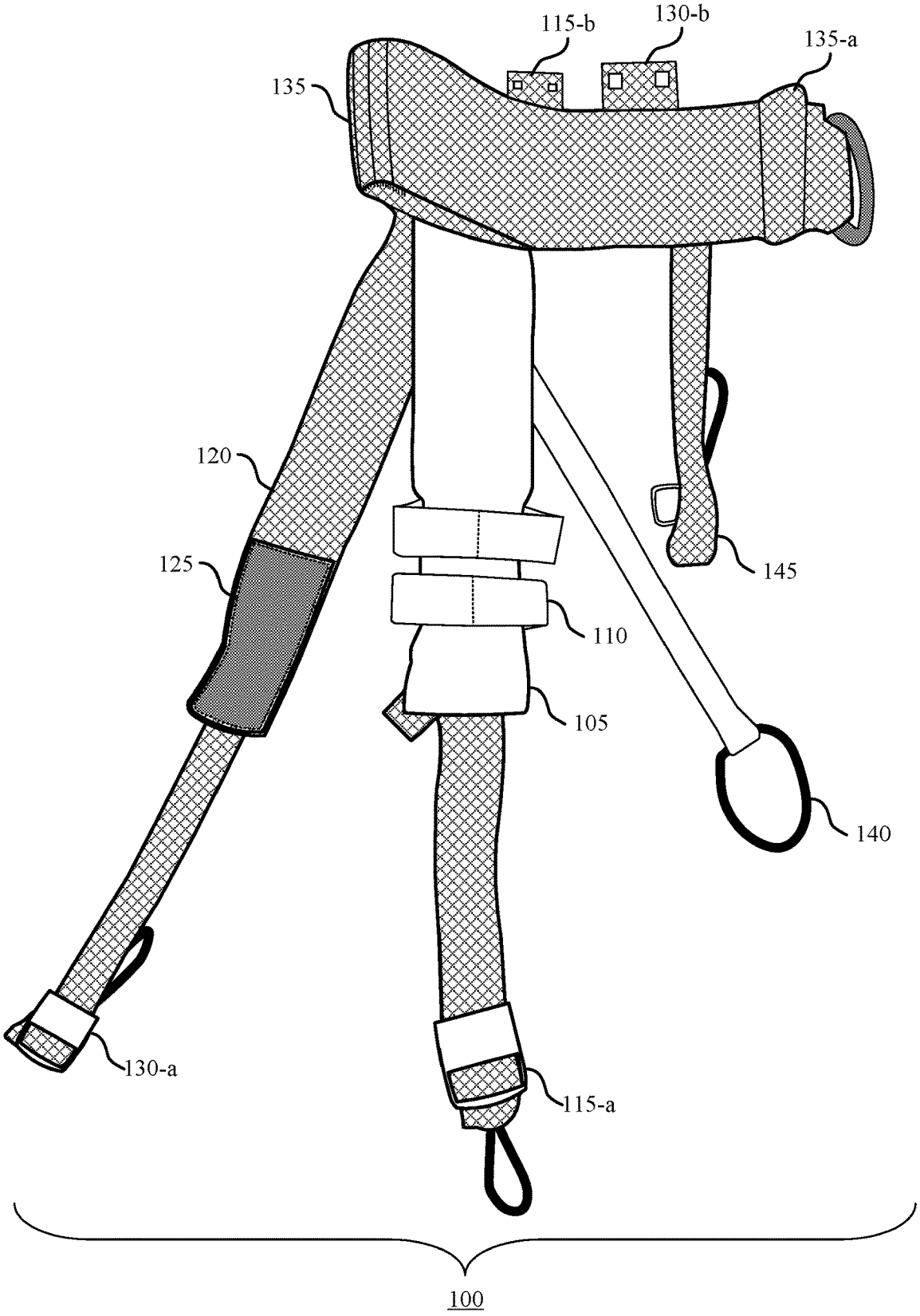
FIG. 1 shows an example of a grip support harness in accordance with aspects of the present disclosure.

FIG. 1 shows an example of a grip support harness 100 in accordance with aspects of the present disclosure. The example shown includes grip support harness 100. Grip support harness 100 may include primary support strap 105, primary connecting component 115, secondary support strap 120, secondary connecting component 130, wrist cuff 135, firing lanyard 140, and tensioning strap 145. Grip support harness 100 may be an example of, or include aspects of, the corresponding element described with reference to FIG. 2.

Wrist cuff 135 may wrap around the wrist of the wearer of the grip support harness 100 to firmly attach the harness to the wearers hand. The wrist cuff 135 may be secured using a fastener such as a slide, a loop, a D-ring, a hook, a buckle, a magnetic buckle, a spring link, a carabiner, a hook or loop fastener.

One or more components of grip support harness 100 may be made using a webbing material such as cotton, nylon, polypropylene, polyester, dyneema, kevlar, or any other webbing. Additionally or alternatively, components of grip support harness 100 may be made from cloth or leather.

The primary support strap 105 may be connected to the wrist cuff 135, and may include a primary tensioning component. The primary support strap 105 may wrap around the index finger (Digitus Secundus Manus) and, in some cases, one or more other fingers to support the grip. Primary support strap 105 may include finger loops 110 to secure the fingers. In one embodiment, the finger loops 110 may include a one or more pieces of webbing material sewn onto the primary support strap 105. In some cases, the finger loops 110 may be adjustable./

The free end of primary support strap 105 may include a primary connecting component 115-*a* such as a slide, a loop, a D-ring, a hook, a buckle, a magnetic buckle, a spring link, a carabiner, a hook or loop fastener. A portion of the primary connecting component 115-*b* may also be connected to the wrist cuff 135.

The secondary support strap 120 may be connected to the wrist cuff 135, and may include a secondary tensioning component. The secondary support strap may be offset from the primary support strap at an angle between 0 degrees and 45 degrees. An end of the secondary support strap 120 may be sewn on to the wrist cuff 135 such that it covers a portion of the baby finger (Digitus Mi'nimus Ma'nus) and wraps around to cover the thumb (Pollex).

Secondary support strap 120 may include thumb protector 125. In some case, the thumb protector 125 is a leather strip sewn on to the secondary support strap to protect the thumb from chafling that may be caused by wearing the grip support harness 100. The free end of secondary support strap 120 may include a secondary connecting component 130-*a* such as a slide, a loop, a D-ring, a hook, a buckle, a magnetic buckle, a spring link, a carabiner, a hook or loop fastener. A portion secondary connecting component 130-*b* may be connected to the wrist cuff 135. The wrist cuff 135 may include a wrist cuff loop 135-*a* that can facilitate securing the wrist cuff 135 to the arm.

The firing lanyard 140 may be connected to the primary support strap 105, and may be used to operate the trigger of a firearm. The firing lanyard 140 may be made from a high visibility color distinct from other components of grip support harness 100 to indicate the importance of its function, and the associated danger. In some embodiments, the firing lanyard 140 may be adjustable in length.

The tensioning strap 145 may be connected to the wrist cuff 135, and may be used to tighten primary support strap 105 or secondary support strap 120.

Figure 2:
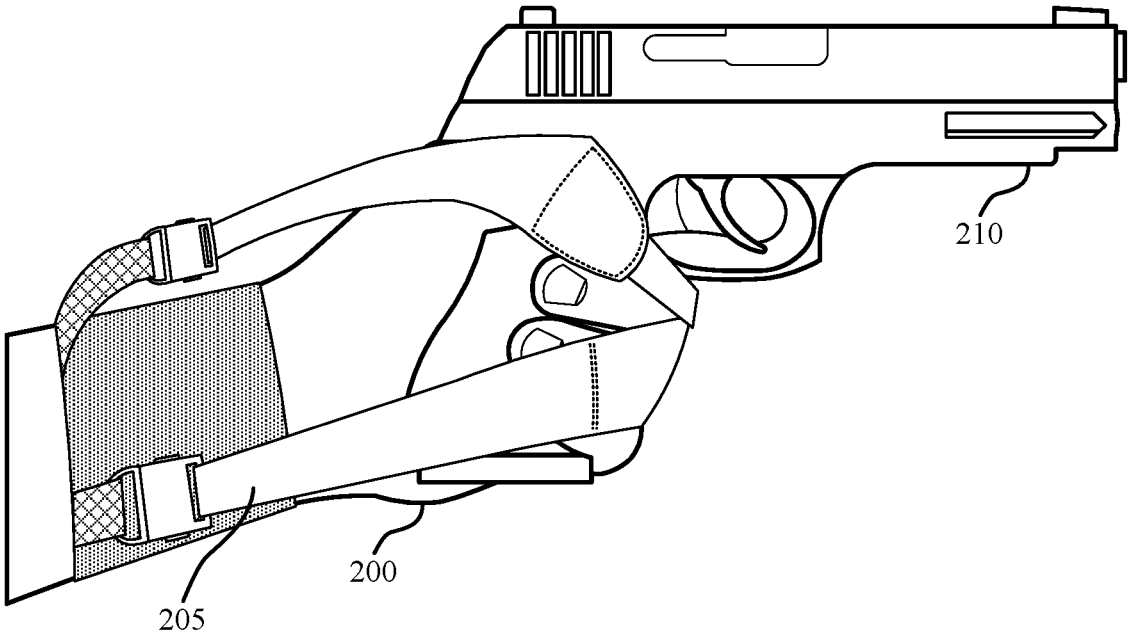
FIG. 2 shows an example of a hand holding a firearm using a grip support harness in accordance with aspects of the present disclosure.

FIG. 2 shows an example of a hand holding a firearm using a grip support harness in accordance with aspects of the present disclosure. The example shown includes hand 200, grip support harness 205, and firearm 210. Grip support harness 205 may be an example of, or include aspects of, the corresponding element described with reference to FIG. 1.

The example illustrates how grip support harness 205 may be used to support the grip of a firearm. However, the grip support harness may also be used to support the grip of other tools and sporting equipment. For example, grip support harness 205 may be used to support the grip of a tool, a racket, a paddle, a bat, or a weight training device.

In some examples, grip support harness 205 may also include a firing lanyard (not shown) that may be used instead of the index finger of hand 200 to pull the trigger of firearm 210. In some examples, a grip interface (also not shown) may be used to secure the grip between hand 200 and firearm 210.

Figure 3:
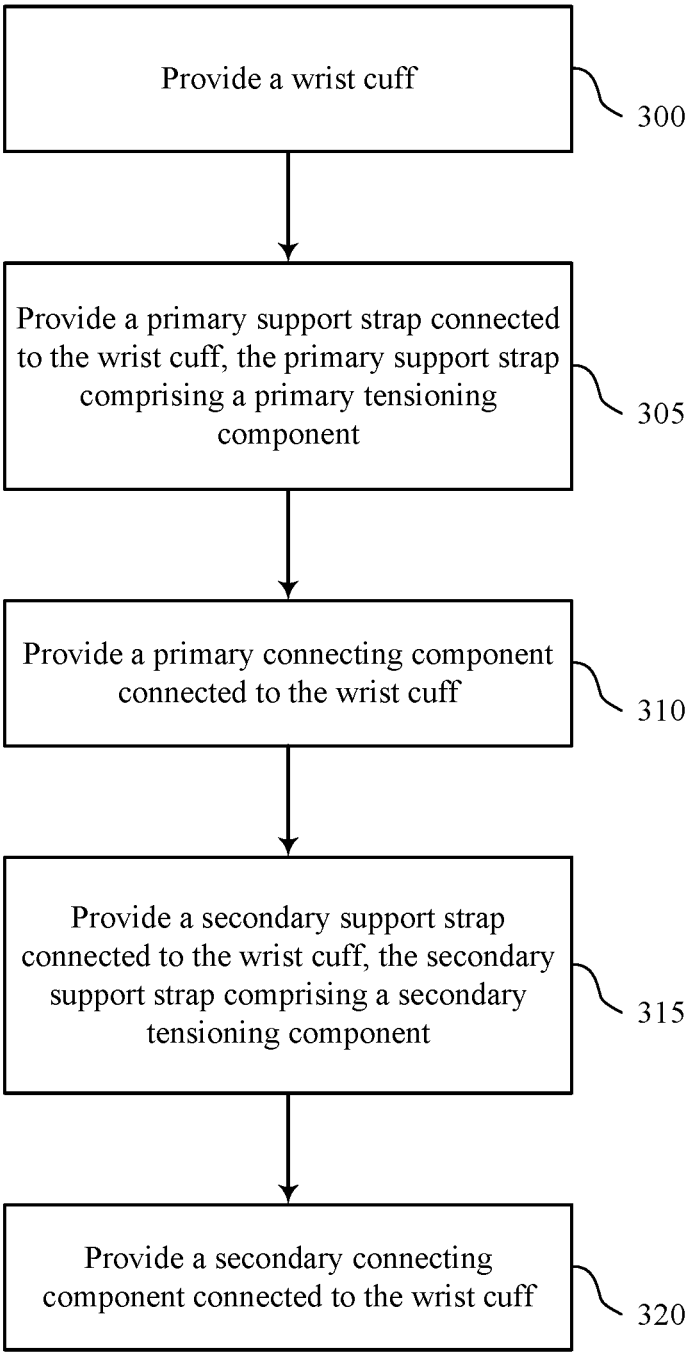
FIG. 3 shows an example of a process for manufacturing a grip support harness in accordance with aspects of the present disclosure.

FIG. 3 shows an example of a process for manufacturing a grip support harness in accordance with aspects of the present disclosure. In some examples, these operations may be performed manually, with a human operated machine, or by an automated machine with a processor executing a set of codes to control functional elements of an apparatus. Additionally or alternatively, the processes may be performed using special-purpose hardware. Generally, these operations may be performed according to the methods and processes described in accordance with aspects of the present disclosure. For example, the operations may be composed of various substeps.

At step 300, a system may provide a wrist cuff. At step 305, a system may provide a primary support strap connected to the wrist cuff, the primary support strap comprising a primary tensioning component. At step 310, a system may provide a primary connecting component connected to the wrist cuff. At step 315, a system may provide a secondary support strap connected to the wrist cuff, the secondary support strap comprising a secondary tensioning component. At step 320, a system may provide a secondary connecting component connected to the wrist cuff.

The description and drawings described herein represent example configurations and do not represent all the implementations within the scope of the claims. For example, the operations and steps may be rearranged, combined or otherwise modified. Also, structures and devices may be represented in the form of block diagrams to represent the relationship between components and avoid obscuring the described concepts. Similar components or features may have the same name but may have different reference numbers corresponding to different figures.

Some modifications to the disclosure may be readily apparent to those skilled in the art, and the principles defined herein may be applied to other variations without departing from the scope of the disclosure. Thus, the disclosure is not limited to the examples and designs described herein, but is to be accorded the broadest scope consistent with the principles and novel features disclosed herein.

In this disclosure and the following claims, the word "or" indicates an inclusive list such that, for example, the list of X, Y, or Z means X or Y or Z or XY or XZ or YZ or XYZ. Also the phrase "based on" is not used to represent a closed set of conditions. For example, a step that is described as "based on condition A" may be based on both condition A and condition B. In other words, the phrase "based on" shall be construed to mean "based at least in part on."

What is claimed is:

1. An apparatus for sporting equipment, comprising:

a wrist cuff consisting of a strap that wraps around a wrist of a user;

a primary support strap directly connected to the wrist cuff;

a primary connecting component directly connected to the wrist cuff;

a secondary support strap directly connected to the wrist cuff;

a secondary connecting component directly connected to the wrist cuff; and a thumb protector connected to the secondary support strap.

2. The apparatus of claim 1, further comprising:

a firing lanyard connected to the primary support strap.

3. The apparatus of claim 1, wherein:

the wrist cuff is configured to be secured using a loop.

4. The apparatus of claim 1, further comprising:

one or more finger loops connected to the primary support strap.

5. The apparatus of claim 1, wherein:

the thumb protector comprises a leather strip.

6. The apparatus of claim 1, wherein:

the secondary support strap is offset from the primary support strap at an angle between 0 degrees and 45 degrees.

7. The apparatus of claim 1, wherein:

the wrist cuff, the primary support strap, the secondary support strap, or any combination thereof comprises a webbing material.

8. The apparatus of claim 7, wherein:

the webbing material comprises cotton, nylon, polypropylene, polyester, dyneema, kevlar, or any combination thereof.

9. The apparatus of claim 1, wherein:

the primary connecting component, the secondary connecting component or both comprise a slide, a loop, a D-ring, a hook, a buckle, a magnetic buckle, a spring link, a carabiner, a hook and loop fastener, or any combination thereof.

10. The apparatus of claim 1, wherein:

the wrist cuff comprises a loop, a slide a D-ring, a hook and loop fastener, or any combination thereof.

11. The apparatus of claim 1, wherein:

the primary support strap and the secondary support strap are sewn onto the wrist cuff.

12. The apparatus of claim 1, further comprising:

a tensioning strap connected to the wrist cuff.

13. The apparatus of claim 1, wherein:

the wrist cuff, the primary support strap, the secondary support strap, or any combination thereof comprises a leather material.

14. A method of manufacturing an apparatus for grip, the method comprising:

providing a wrist cuff consisting of a strap that wraps around a wrist of a user;

providing a primary support strap directly connected to the wrist cuff;

providing a primary connecting component directly connected to the wrist cuff;

providing a secondary support strap directly connected to the wrist cuff;

providing a secondary connecting component directly connected to the wrist cuff; and providing a firing lanyard connected to the primary support strap.

15. The method of claim 14, the method further comprising:

providing one or more finger loops connected to the primary support strap.

16. A method of using an apparatus for grip support, the method comprising:

using a wrist cuff to attach the apparatus to a hand or arm, wherein the wrist cuff consists of a strap that wraps around a wrist of a user;

using a primary support strap directly connected to the wrist cuff to support a first set of fingers;

using a primary connecting component to connect a detached end of the primary support strap to the wrist cuff;

using a secondary support strap directly connected to the wrist cuff to support a second set of fingers;

using a secondary connecting component connected to the wrist cuff to connect a detached end of the secondary connecting support strap to the wrist cuff; and using a firing lanyard connected to the primary support strap to fire a firearm.

* * * * *